United States Patent [19]

Kitrick

[11] 4,207,715

[45] Jun. 17, 1980

[54] TENSEGRITY MODULE STRUCTURE AND METHOD OF INTERCONNECTING THE MODULES

[76] Inventor: Christopher J. Kitrick, 3500 Market St., Philadelphia, Pa. 19104

[21] Appl. No.: 942,301

[22] Filed: Sep. 14, 1978

[51] Int. Cl.[2] ..... E04B 1/32

[52] U.S. Cl. ..... 52/81; 52/747; 52/DIG. 10

[58] Field of Search ..... 52/81, DIG. 10, 747

[56] References Cited

U.S. PATENT DOCUMENTS

| | | | |
|---|---|---|---|
| 3,063,521 | 11/1962 | Fuller | 52/81 X |
| 3,354,591 | 11/1967 | Fuller | 52/588 X |

FOREIGN PATENT DOCUMENTS

| | | | |
|---|---|---|---|
| 659780 | 1/1964 | Italy | 52/608 |

*Primary Examiner*—Price C. Faw, Jr.
*Assistant Examiner*—Carl D. Friedman
*Attorney, Agent, or Firm*—Parmelee, Johnson, Bollinger & Bramblett

[57] ABSTRACT

A tensegrity structure is formed from a plurality of interconnected tensegrity modules. Each module includes several column-like compression members and tension elements run between ends of the compression members to define a polyhedron. The tension elements form the edges of the polyhedron and intersect at the vertices of the polyhedron. The interconnected modules are joined to each other with triangular faces abutting but with the edges and faces of the abutting triangular surfaces of the respective modules rotated 180° away from superposition and with the vertices joined to tension element edges, being joined at a point located one-half or one-third of the way along the length of such edge.

7 Claims, 17 Drawing Figures

Fig. 3.
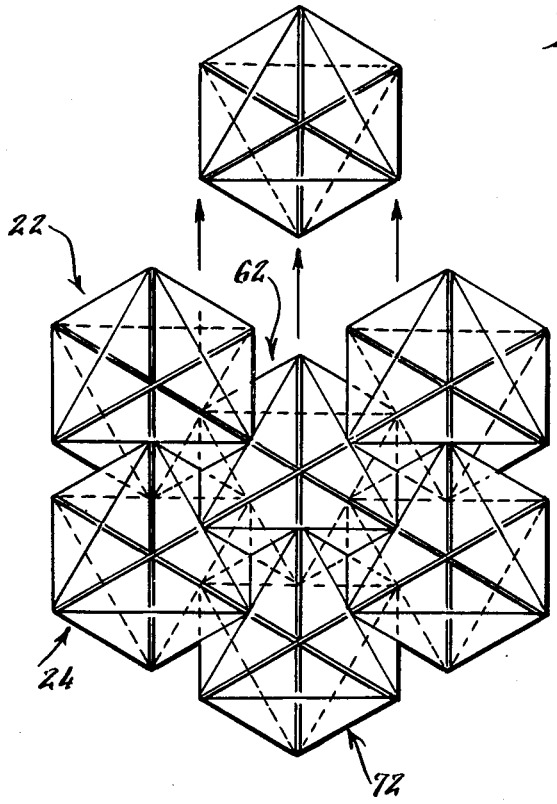
Fig. 4.
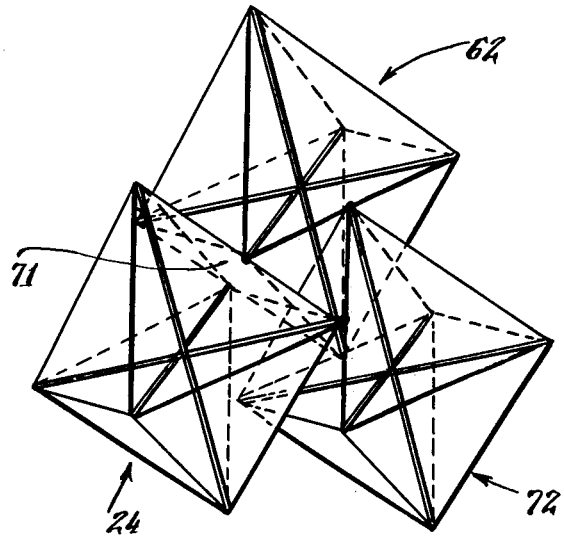
Fig. 5.
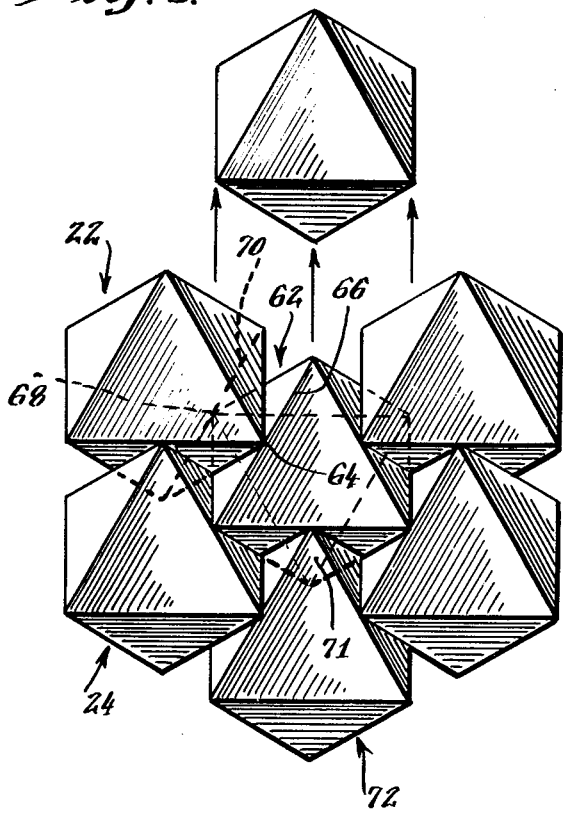
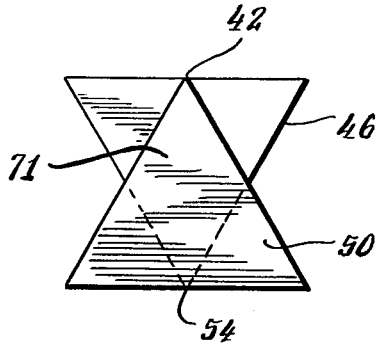
Fig. 5A.

TENSEGRITY MODULE STRUCTURE AND METHOD OF INTERCONNECTING THE MODULES

BACKGROUND OF THE INVENTION

This invention relates to a tensegrity structure and more particularly to such a structure which is constructed from a number of tensegrity modules.

In his U.S. Pat. No. 3,063,521, Richard Buckminster Fuller introduced the tensile integrity, or tensegrity, construction technique. Tensegrity construction is based on the realization that most building materials are much more efficiently utilized, smaller cross sectional areas can be employed, and the materials can often withstand higher forces, when in tension than when in compression. In tensegrity construction there is a high ratio of tension to compression elements. The tension elements provide continuous lines of tension throughout a structure; whereas there is separation of the compression forces such that the compression members are discontinuous. The compression members in effect float within a sea of tension.

In the above-mentioned Fuller patent, the basic tensegrity element is an octahedron formed of three column-like compression members arranged in a tepee fashion with the ends thereof interconnected by tension wires or cables. The end of each compression member is positioned near the vertex of the octahedron where tension elements intersect, and each tension element runs along an edge of the octahedron. The octahedrons are joined vertex-to-vertex, the compression members thus being in "apparent" continuity. The term apparent continuity is used, for although the continuity in a structural sense is real, because of the resultant tension forces at each intersection of the vertices, the result is discontinuity in respect of functions in compression at that point. The compression members are joined end-to-end but no compressive force is transferred through the intersection.

In a more recent Fuller U.S. Pat. No. 3,354,591, octahedral tensegrity modules are joined face-to-face with compression members of each two interconnecting modules connected at the three vertices of the abutting faces. Each tensegrity module advantageously has a pure tension to pure compression element ratio of four to one. However, with the modules joined face-to-face, the tension elements along the edges of each abutting face become redundant; that is, two tension wires are provided along a single edge where only one is required. If one of those redundant tension elements were eliminated for each edge, the ratio between tension and compression elements is reduced to three to one.

An object of the present invention is to provide tensegrity structure which makes optimum use of each tension element within the structure while keeping a high ratio of tension to compression elements.

SUMMARY

In accordance with the invention in one of its aspects, a tensegrity structure is formed by interconnecting a plurality of tensegrity polyhedral modules, each two interconnected modules having a vertex of a first module joined to an edge of a second module and a vertex of the second module joined to an edge of the first module.

In accordance with the invention in another of its aspects, each tensegrity module includes column-like compression members and tension elements extending between ends thereof. The tension elements define the edges of a three-dimensional geometric figure having at least four triangular faces and they intersect at the vertices of the geometric figure. Each module is joined to another module with faces abutting but with edges of the abutting faces being nonaligned. The faces of the abutting triangular surfaces of the respective modules are rotated 180° out of superposition. A vertex of each abutting triangular face is joined to an edge of the abutted face, being joined at a point located one-half or one-third of the way along the length of such edge.

If one embodiment of the invention, each tensegrity module is an octahedron formed of three compression members and all of the interconnected modules are arranged with their faces co-planar such that the tensegrity structure has a face characterized by an array of triangles interlaced with three-sided dimples.

In accordance with another embodiment of the invention, each tensegrity module is a tetrahedron including four compression members joined at a center point, and the modules are interconnected such that the face of the tensegrity structure is characterized by an array of pyramidal dimples. By offsetting the vertices from the midpoint of the joined edges, intersection of vertices is avoided and the tensegrity structure is formed of an array of pyramidal dimples of two sizes.

In yet another embodiment of the invention, each tensegrity module is an icosahedron.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 3 is a plan view of seven octahedral tensegrity modules with the compression members and tension elements shown, six of the elements are interconnected and the seventh is positioned in readiness for interconnection;

FIG. 4 is an angled view of three of the octahedral tensegrity modules of FIG. 3;

FIG. 5 is a plan view of the seven octahedral tensegrity modules of FIG. 3 but with each module shown as a solid figure;

FIG. 5A is a diagram on enlarged scale showing the relative orientation of two abutting triangular faces for purposes of explanation;

DESCRIPTION OF PREFERRED EMBODIMENTS OF THE INVENTION

Figure 1A:
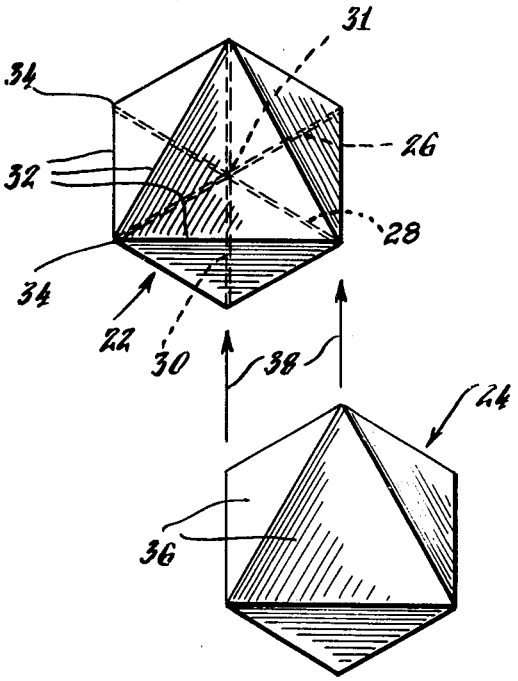
Fig. 1A. PRIOR ART
FIG. 1A is a plan view of two octahedral tensegrity modules of the prior art.

Two octahedral tensegrity modules 22 and 24 of the prior art are shown in FIG. 1A. As shown in broken lines on the module 22, each module comprises three column-like compression members or struts 26, 28 and 30 which are positioned to form three orthogonal axes. Tension wires 32 extend between the ends of the compression members. Each wire can be seen as an edge of an octahedron having triangular faces and the tension wires 32 intersect at the vertices of the octahedron. If each triangular face is covered with a membrane or skin, then each of the octahedral modules 22 and 24 can be perceived as two solid pyramidal figures joined base-to-base.

Figure 1B:
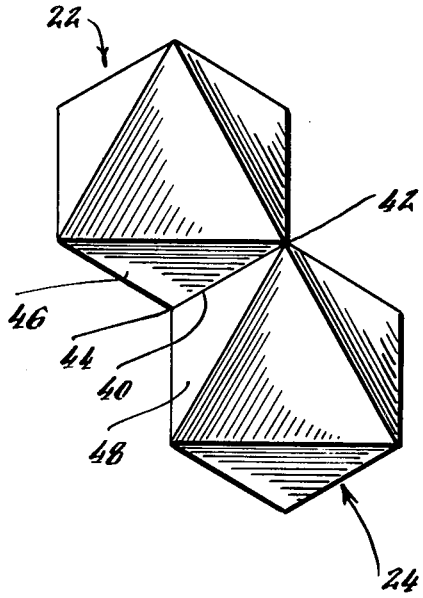
Fig. 1B. PRIOR ART
FIG. 1B is a plan view of the two tensegrity modules of FIG. 1A interconnected in one arrangement of the prior art.

When the modules 22 and 24 are moved together as indicated by the arrows 38 in FIG. 1A they may be interconnected as shown in FIG. 1B. The two modules are joined along a common edge 40 and at vertices 42 and 44. In this arrangement one of the tension wires along the edge 40 is redundant and can be eliminated. But by eliminating the tension wire, the ratio of tension elements to compression member is reduced.

In another prior art arrangement shown in the Fuller U.S. Pat. No. 3,354,591, the modules 22 and 24 are interconnected face-to-face with faces 46 and 48 abutting, and the edges of those faces including edge 40 joined. In that interconnection of the modules, three tension wires are rendered redundant with each interconnection.

Figure 2A:
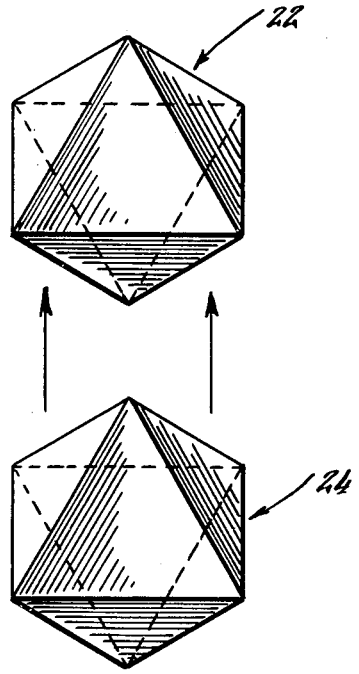
FIG. 2A is a plan view similar to FIG. 1A but of two octahedral tensegrity modules positioned for interconnection in accordance with the present invention.
Figure 2B:
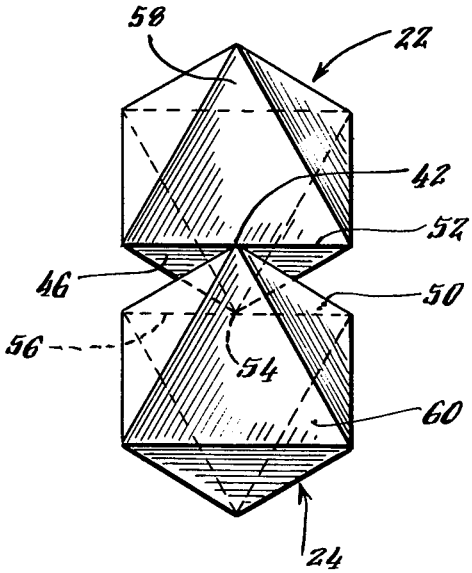
FIG. 2B is a plan view similar to FIG. 1B but with the tensegrity modules interconnected with overlapping faces and with vertices joined to edges in accordance with the present invention.

FIG. 2A shows the two octahedral tensegrity modules 22 and 24 positioned for interconnection in accordance with the present invention. As shown in FIG. 2B, the module 24 overlaps module 22 with portions of the faces 46 and 50 abutting each other. The edges of the faces 46 and 50 are nonaligned with the vertex 42 of module 24 joined to the edge 52 of module 22 at the midpoint thereof. Similarly, a vertex 54 of the module 22 is joined to the edge 56 of module 24 at the midpoint of that edge. With the modules similarly oriented as they are shown in FIG. 2B, the triangular faces 58 and 60, which may form a segment of a structural surface, lie in a common plane.

Multiple tensegrity modules may be similarly oriented and interconnected as shown in FIGS. 3 through 6. Each two interconnecting modules, such as 22 and 24, 22 and 62, and 24 and 62, are interconnected with portions of the triangular faces abutting each other. A vertex of each abutting module face is joined with an edge of the abutted face. Thus, as best shown in FIG. 5, with module 22 abutting module 62, vertex 64 of module 22 is joined to edge 66 of the module 62. Conversely, with module 62 abutting module 22, a vertex 68 of module 62 is joined to edge 70 of the module 22.

When the vertex of a first octahedral module is joined to the midpoint of the edge of a second abutting octahedral module and a vertex of the second octahedral module is joined to the midpoint of an edge of the first module with a portion of a triangular face of the first module abutting against a portion of the face of the second (as seen in FIGS. 2 through 5), then the portions of the two respective triangular faces which are abutting are each four-sided, namely each being a rhombus. Such an abutting rhombus-shaped area portion is seen clearly in FIG. 4 in dotted outline at 71. For purposes of illustration, such a rhombus shaped abutting area 71 is shown in darkened outline in FIG. 5.

The diagram of FIG. 5A shows a triangular face 46, for example such as the face of the octahedral module 22 shown in FIG. 2B, abutting against a triangular face 50 of the octahedral module 24. The rhombus shaped area 71 of the abutting portions of the triangular faces is seen clearly in FIG. 5A. Also, it is to be noted that each triangular face 46 or 50 is rotated 180° out of superposition with respect to the other triangular face.

As best seen in FIG. 4, in which the modules are viewed from a different angle than in FIG. 3, the compression members of interconnected modules do not intersect. Thus, the respective compression members are completely in compression discontinuity, even apparent continuity being avoided. Although tension elements cross, none of those elements are aligned. Thus, none of the tension elements are redundant, and a full four to one ratio of tension to compression elements is maintained in the structures shown in FIGS. 2 through 5.

Figure 6:
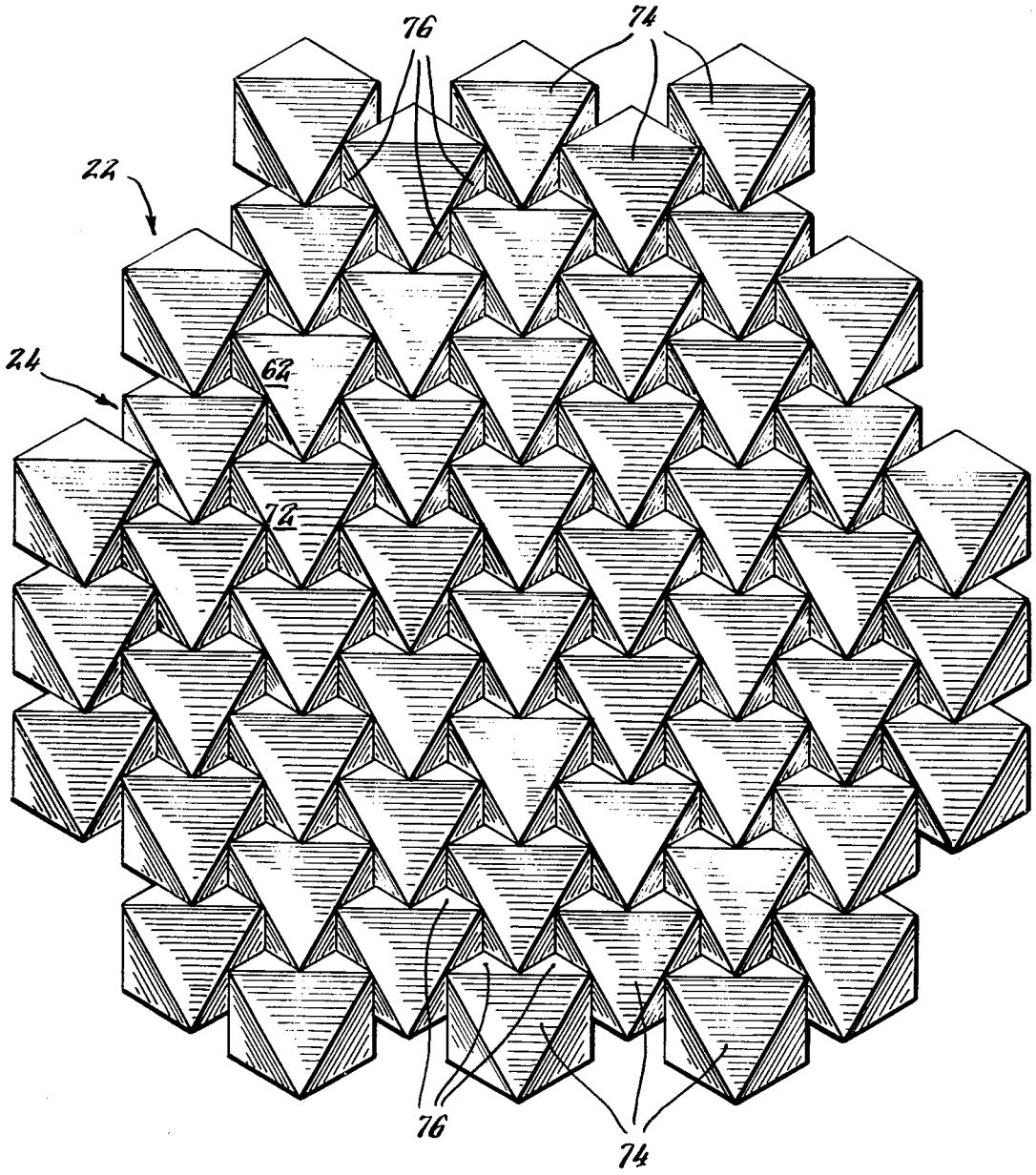
FIG. 6 is a plan view similar to FIG. 5 but showing a large number of modules shown on a reduced scale.

FIG. 6 shows a floor or wall or layer of tensegrity modules arranged as in FIGS. 2 through 5. It can be noted that each module has a triangular face 74 lying in the same plane as the corresponding triangular face of each of the other modules. This common plane in which lie all of the corresponding triangular faces 74 of the modules can be considered to be the face surface of the tensegrity structure. The regions between these corresponding co-planar triangular faces 74 contain three-sided dimples 76, i.e. tetrahedral configured dimples, which give the tensegrity structure an unusual and pleasing appearance. Each dimple is formed from the exposed surfaces of the abutting faces of three modules.

Thus, advantageously the octahedral modules can be so arranged and interconnected as to form a wall or floor truss. As shown in FIG. 6 each module, or the outer surface of a completed structure, has a membrane, or skin, across the octahedron faces to provide a floor surface. If a completely uniform and flat face is desired, then the membrane, which may in fact be formed of concrete, metal, plastic, wood or the like, can be extended across the dimples as well as the co-planar triangular faces for forming a continuous flat surface.

It is not necessary that the outer surface of the modular structure be planar. By suitably dimensioning the compression members and tension elements within each module, the interconnected modules may form a dome or an arch or the like.

Further, the tensegrity modules need not be octahedrons. For example, as shown in FIGS. 7 through 10, tetrahedral modules may be interconnected with nonaligned abutting faces such that a vertex of each abutting triangular face is joined to an edge of the abutted face.

Figure 7:
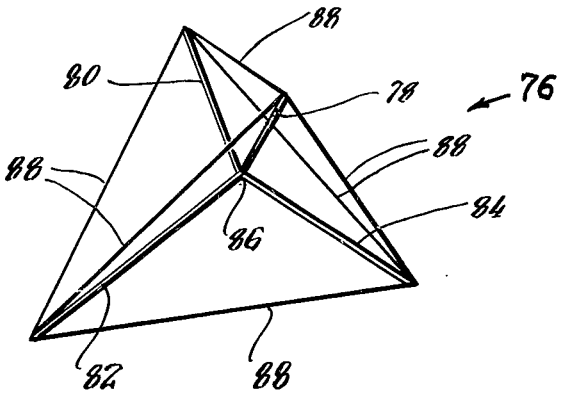
FIG. 7 is a view of a tetrahedral tensegrity module having four compression members joined at a center point.

FIG. 7 shows the basic tetrahedral tensegrity module 76. The module 76 comprises four compression members 78, 80, 82 and 84 joined at a center point 86. The outer ends of the compression members remote from the center 86 are interconnected by six tension elements 88 which form the edges of four equilateral triangular faces. Three tension elements 88 intersect at each of the four vertices of the tetrahedron.

As with the octahedrons, each tetrahedron may at least be partially covered with a skin so that at least the outer surface of a structure composed of the interconnected modules is closed.

Figure 8:
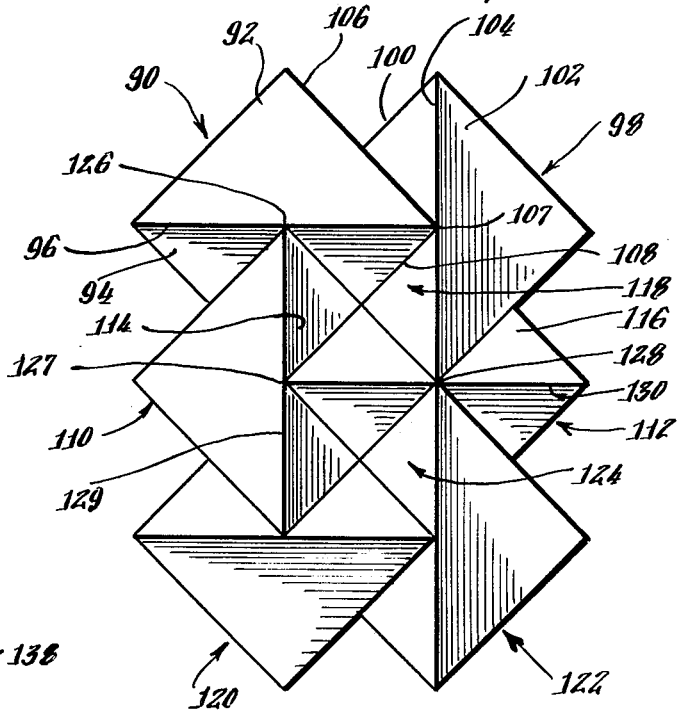
FIG. 8 is a plan view of six interconnected tetrahedral tensegrity modules shown as solid figures.

Six tetrahedral modules shown in the form of solid figures, that is, with a skin over each face, are interconnected in accordance with the present invention as shown in FIG. 8. A first tetrahedral module 90 has two upper triangular faces 92 and 94. It is to be understood that these two faces 92 and 94 slope downwardly and diverge from an upper edge 96, said upper edge 96 appearing much like the ridge of a roof. Two lower triangular faces (which are not seen in FIG. 8) slope downwardly and converge to an edge orthogonal to and spaced below the edge 96. The module 90 abuts and is interconnected with another module 98 having upper faces 100 and 102 sloping downwardly and diverging from an edge 104. A portion of the face 100 of module 98 is abutted by a portion of the face of the module 90 not shown, the latter face having edges 106 and 108 as well as the edge orthogonal to and spaced below the edge 96.

In the structure as shown in FIG. 8 in which a vertex 107 of the tetrahedron module 90 is joined to a midpoint of the edge 104 of the tetrahedron module 98, then the abutting portions of the equilateral triangular faces are rhombus shaped, similar to the relationship shown in FIG. 5A. Also, each abutting triangular face is rotated 180° out of superposition with respect to the other triangular face, similar to the relationship shown in FIG. 5A.

Similarly, a third module 110 overlaps and abuts the face 94 of module 90 and a fourth module 112 overlaps and abuts the face 114 of module 110. The face 116 of module 112 is in turn overlapped by the module 98 and abuts a face thereof. Thus, the four modules 90, 98, 110 and 112 can be seen to form a continuous overlapping arrangement defining and encircling a pyramidal dimple 118, with a vertex of one being joined to a midpoint of an edge of another.

The structure can be continued by interconnecting additional modules in a similar fashion, each set of four interconnecting modules encircling a pyramidal dimple. The face of the completed structure is an array of such dimples 118, 124, and so forth. Each two interconnected modules have nonaligned abutting faces, and a vertex of each abutting triangular face, such as vertex 107, 126, 127 or 128 is joined to a midpoint of an edge of the abutted face, such as the respective edge 104, 96, 129 or 130, which encircle the pyramidal dimple 118.

As with the octahedral tensegrity arrangement, there is no redundancy of edges in the tetrahedral tensegrity arrangement shown in FIG. 8; that is, there are no two edges of adjoining modules which are aligned to render one of the edges unnecessary.

It is interesting to note that in the structure shown in FIG. 6 formed of octahedral modules the dimples 76 are tetrahedral in shape; while in the structure shown in FIG. 8 formed of tetrahedral modules, the dimples are pyramidal in shape, thus each being one-half of an octahedron.

Unlike the octahedral embodiment shown in FIG. 6, the tetrahedral embodiment, as shown in FIG. 8 does include vertex-to-vertex interconnections between the modules. For example, module 98 intersects module 122 at a common vertex 128. The result is an apparent continuity between the two modules joined to the edge 130. This apparent continuity requires a flexible hub or the like for joining two compression members to a tension element at a single point. This requirement of a flexible hub can be avoided by the use of the modular arrangement shown in FIG. 9.

Figure 9:
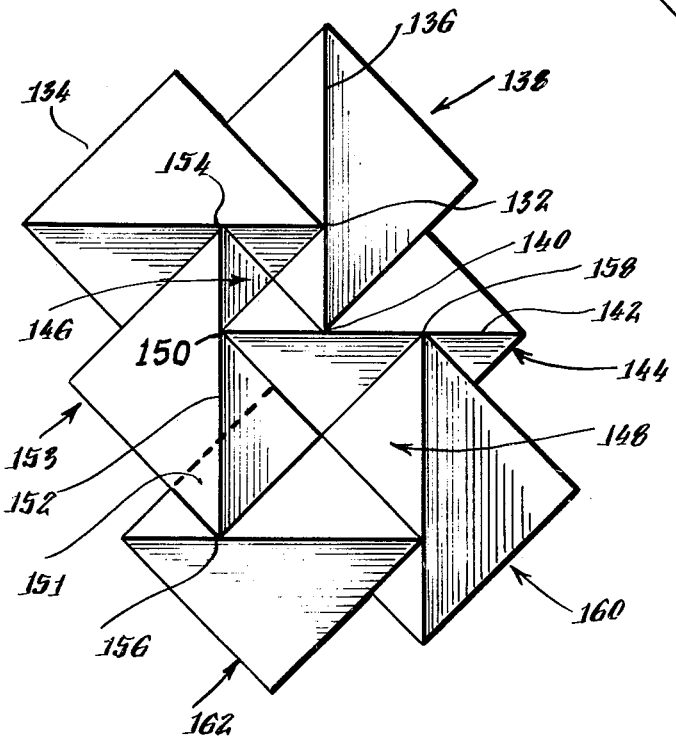
FIG. 9 is a plan view similar to FIG. 8 of six tetrahedral tensegrity modules but with vertices joined at other than the midpoints of edges.

In the embodiment of FIG. 9, each vertex is joined to an edge of another module at a one-third-point of the edge.

For example, the vertex 132 of the module 134 is joined to the edge 136 of module 138 at a point which is located one-third of the length of the edge 136 from vertex 140. The two modules 134 and 138 are thus interconnected with nonaligned abutting triangular faces but with the respective vertices intersecting edges of adjoining modules at a one-third-point. Similarly, the vertex 140 of module 138 intersects the edge 142 of module 144 at a one-third-point. The modules have a continuous overlapping arrangement as in the embodiment of FIG. 8 around a pyramidal dimple 146. However, the sides of that dimple 146 are only two-thirds the length of the sides of the dimples 118 and 124.

The next set of overlapping modules then form a larger dimple 148 which has sides 1⅓ times the length of the sides of dimples 118 and 124, that is, being twice the length of the sides of the smaller dimple 146. The vertex 150, being located at a one-third of edge 152 from the vertex 154, is correspondingly located at a two-thirds-point of edge 152 from the opposite vertex 156. This two-thirds line segment of the edge 152 forms one boundary of the dimple 148. Continuing in the same fashion, vertex 158 is joined to the edge 142 at a point which is two-thirds of the length of that edge from vertex 150 and so on. The abutting portions of the equilateral triangular faces of adjoining modules are parallelogram shaped as illustrated in dark lines at 151 in FIG. 9.

Figure 9A:
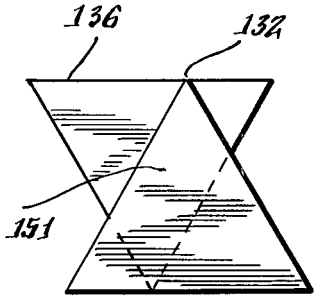
FIG. 9A is a diagram, shown on enlarged scale, illustrating the orientation of two abutting triangular faces for purposes of explanation.

In the diagram shown in FIG. 9A the vertex 132 of one triangular face is joined at the one-third point of the edge 136 of the abutting triangular face. The parallelogram shape 151 of the abutting portions of the two triangular faces of the respective modules 138 and 134 is seen clearly in FIG. 9A. The interrelationship between the two abutting triangular faces as seen in FIG. 9A is that each triangular face is rotated 180° away from superposition with respect to the other and then is shifted laterally by one-sixth of its width so that its vertex joins the edge of the other at a point one-third of the way along the length of such edge.

Figure 10:
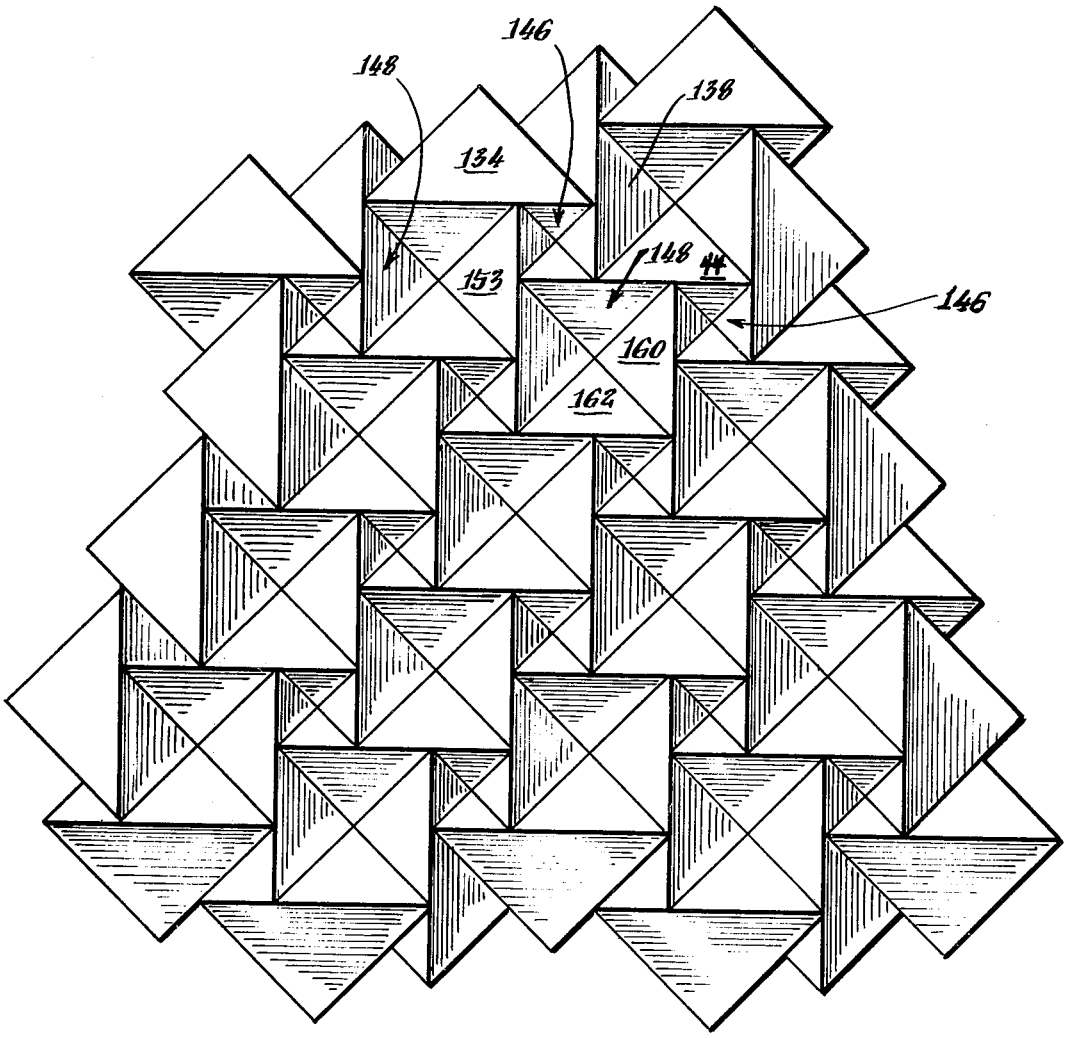
FIG. 10 is a plan view similar to FIG. 9 but of a large number of tetrahedral tensegrity modules shown on a reduced scale.

By similarly interconnecting a large number of tetrahedral tensegrity modules with vertices joined to one-third-points of respective edges of the modules, the completed structure assumes the attractive configuration shown in FIG. 10. The entire face of the structure is formed of large and small pyramidal dimples 146 and 148, respectively. As before, these dimples may be covered with a continuous membrane to form a flat plane. The dimensions of the compression members and tension elements may be set such that the structure assumes other than a planar configuration, such as a dome or arch, or the like.

Figure 11:
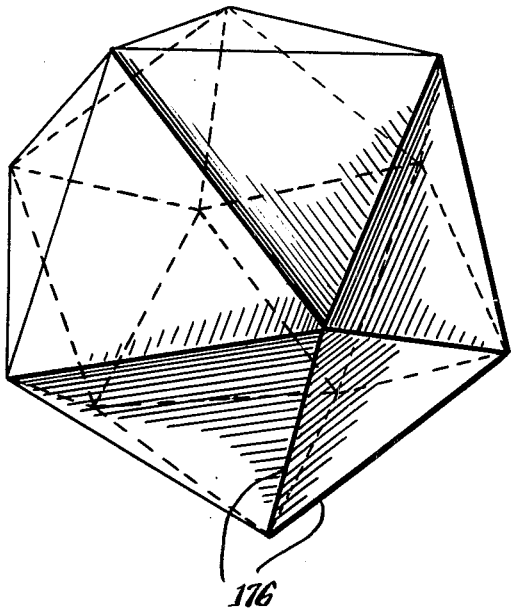
FIG. 11 is a view of an icosahedral tensegrity element viewed as a solid figure.
Figure 12:
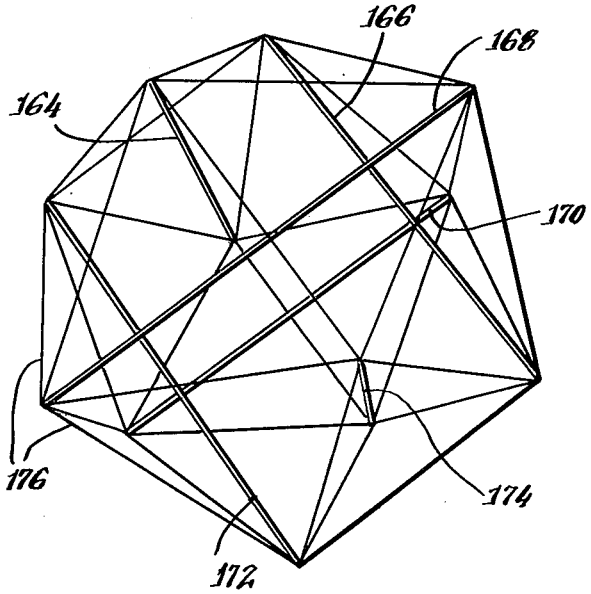
FIG. 12 is a view similar to FIG. 11 but with compression members and tension elements being illustrated.

An icosahedron, that is a solid figure having twenty planar triangular faces, is shown in FIG. 11. Each of the triangular faces is defined by three tension elements. An icosahedral tensegrity element may be constructed as shown in FIG. 12. Six nonintersecting compression members 164 through 174 are interconnected by tension elements 176. As before, tension elements 176 form the edges of the twenty triangular faces of the icosahedron and intersect at the vertices.

Figure 13:
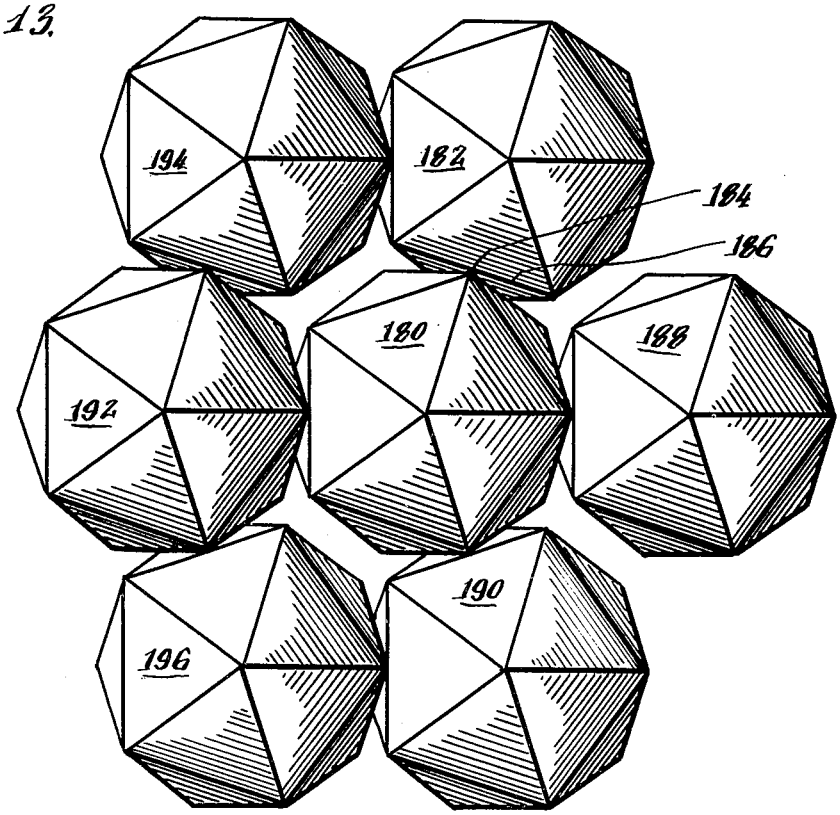
FIG. 13 is a plan view of seven icosahedral tensegrity modules interconnected in accordance with the present invention.

In FIG. 13 seven icosahedral tensegrity modules are shown interconnected in a face overlapping arrangement in accordance with the present invention.

With all of the icosahedrons similarly aligned, each module interconnects with four other modules at overlapping faces. For example, module 180 in FIG. 13 is positioned face-to-face with module 182, the vertex 184 of module 180 being joined to the midpoint of the edge 186 of module 182. Similarly, module 180 is interconnected to modules 188, 190 and 192 with faces abutting and vertices joined to the midpoints of respective edges. A tensegrity structure can be built by interconnecting additional modules such as modules 194 and 196.

While the invention has been particularly shown and described with reference to preferred embodiments thereof, it will be understood by those skilled in the art that various changes in form and details may be made therein without departing from the spirit and scope of the invention as defined by the appended claims.

I claim:

1. A tensegrity structure comprising a plurality of interconnected octahedral tensegrity modules:

each octahedral module including three columnlike compression members and twelve tension elements extending between the respective ends thereof, said tension elements defining the twelve edges of an octahedral geometric figure having eight triangular faces, the tension elements intersecting at the respective vertices of said octahedral geometric figure, each octahedral module being interconnected with another octahedral module with portions of their respective triangular faces abutting each other, but with such abutting triangular faces being relatively rotated 180° away from superposition with respect to each other, a vertex of each abutting triangular face being joined to the midpoint of an edge of the abutted triangular face, said structure having a surface with one triangular face of each of said octahedral modules lying in said surface, and said surface having the appearance of an array of triangles interlaced with three-sided tetrahedral-shaped dimples.

2. A tensegrity structure as claimed in claim 1, in which:

said surface of said structure lies in a plane and said array of said triangular faces is coplanar, lying in said plane, and said three-sided tetrahedral-shaped dimples each extends down below said plane.

3. A tensegrity structure comprising a plurality of interconnected tensegrity tetrahedron modules:

each tetrahedron module including four column-like compression members and six tension elements extending between the respective ends thereof, said tension elements defining the six edges of a tetrahedron geometric figure having four triangular faces, the tension elements intersecting at the four vertices of each tetrahedron module, each tetrahedron module being interconnected with another tetrahedron module with portions of the respective triangular faces abutting each other, such abutting triangular faces being relatively rotated 180° away from superposition with respect to each other and also being shifted laterally with respect to each other by a fraction of the width of said abutting triangular faces, a vertex of each abutting triangular face being joined to an edge of the abutted triangular face at a point offset from the midpoint of said edge.

4. A tensegrity structure comprising a plurality of interconnected tensegrity tetrahedron modules, as claimed in claim 3, in which:

the vertex of each abutting triangular face is joined to the edge of the abutted triangular face at a point which is one-third of the way along the length of such edge, the resulting structure has an overall outside configuration defined by two pluralities of pyramidal-shaped dimples of different sizes, and said dimples of the first plurality having linear dimensions which are twice the size of the corresponding linear dimensions of the dimples of the second plurality.

5. A tensegrity structure comprising a plurality of interconnected icosahedron tensegrity modules:

each icosahedron module including six non-intersecting column-like compression members and thirty tension elements extending between the respective ends thereof, said tension elements defining the edges of an icosahedron geometric figure having twenty triangular faces, the tension elements intersecting at the vertices of said icosahedron module, each icosahedron module being interconnected with another icosahedron module with portions of the respective triangular faces abutting each other, but with such abutting triangular faces being relatively rotated 180° away from superposition with respect to each other, a vertex of each abutting triangular face being joined to the midpoint of an edge of the abutted triangular face.

6. The method of constructing a tensegrity structure comprising the steps of:

providing a plurality of tensegrity polyhedral modules each having triangular faces, interconnecting said tensegrity modules by abutting a triangular face of one module against a triangular face of the adjoining module, each two interconnected modules having a vertex of the triangular face of a first module joined to an edge of the triangular face of a second module and a vertex of the triangular face of the second module joined to an edge of the triangular face of the first module, said abutting triangular faces of the two adjoining modules having the vertex of one offset from the midpoint of the edge of the second, whereby the abutting portions of said triangular faces are parallelogram-shaped, and the overall configuration of a side of the tensegrity structure has two pluralities of pyramidal-shaped dimples of different sizes.

7. The method of constructing a tensegrity structure, as claimed in claim 6, including the step of:

connecting the vertex of each abutting triangular face of one module to an edge of the abutted triangular face of the other module at a point which is located one-third of the way along such edge, whereby the linear dimensions of the pyramidal dimples of said first plurality are twice as large as the linear dimensions of the pyramidal dimples of said second plurality.

* * * * *